United States Patent [19]

Herrington

[11] Patent Number: 4,816,817

[45] Date of Patent: Mar. 28, 1989

[54] LINE MOVER FOR BIT-MAPPED DISPLAY

[75] Inventor: Richard A. Herrington, Fort Collins, Colo.

[73] Assignee: Hewlett-Packard Company, Palo Alto, Calif.

[21] Appl. No.: 142,315

[22] Filed: Dec. 29, 1987

Related U.S. Application Data

[63] Continuation of Ser. No. 750,351, Jun. 28, 1985, abandoned.

[51] Int. Cl.[4] ..... G09G 1/00

[52] U.S. Cl. ..... 340/801; 340/724; 340/744; 340/803

[58] Field of Search ..... 340/723, 724, 726, 727, 340/744, 747, 750, 800, 801, 803, 804, 721, 734

[56] References Cited

U.S. PATENT DOCUMENTS

| | | | |
|---|---|---|---|
| 4,297,693 | 10/1981 | Parsons | 340/801 |
| 4,303,986 | 12/1981 | Lans | 340/750 |
| 4,511,962 | 4/1985 | Machida et al. | 340/724 |
| 4,635,049 | 1/1987 | Dodge et al. | 340/801 |
| 4,636,783 | 1/1987 | Omachi | 340/724 |

*Primary Examiner*—John W. Caldwell, Sr.
*Assistant Examiner*—Jeffery A. Brier
*Attorney, Agent, or Firm*—Edward L. Miller

[57] ABSTRACT

The pixel contents of a frame buffer scan line segment are moved from a source location to a destination location by reading fields of the source segment into a source data shift register and fields of the destination segment into a destination data shift register. The contents of the shift registers may then be rotated relative to one another to account for different starting locations within source and destination fields. The contents of the two shift registers are then simultaneously and synchronously shifted into an ALU where a replacement rule may be used to create a modified stream of pixels shifted into the emptying portion of the destination data shift register. At the conclusion of the shifting for that field the destination data shift register contains the proper pixels to be written back to the destination location in the frame buffer. Then the process is repeated for any remaining fields in the segment being moved. In the special case of scrolling a vertical column the fields are read directly into the destination data shift register and immediately rewritten to the destination location.

5 Claims, 1 Drawing Sheet

LINE MOVER FOR BIT-MAPPED DISPLAY

This application is a continuation of application Ser. No. 750,351, filed on June 28, 1985, now abandoned.

BACKGROUND AND SUMMARY OF THE INVENTION

Bit-mapped displays in computer systems are becoming more prevalent, especially in the so-called engineering work stations where graphics, often in color play an important part in the work done by the computer. In a bit-mapped display a collection of memory known as a frame buffer contains one or more bits for each pixel (dot) to be displayed, usually on a CRT. For example, if the displayed image area were 1024 pixels wide by 1024 pixels high then 1,048,576 bits (per plane) would be needed as a frame buffer for a black and white display. In a color display there can be several planes in the frame buffer, so that each pixel can be described with a corresponding number of bits. These additional bits can be used to assign color and other attributes, such as intensity, depth, translucence, etc.

The bit-mapped architecture set out above is in distinct contrast with its simpler and less general predecessor, the alpha or character display. In those systems the display is limited to displaying the various characters of a predetermined character set. Each address of the frame buffer holds a character code for the character to be displayed at the corresponding location upon the display. Specially dedicated hardware takes care of converting the character to the correct sequence of pixels. In a raster scan display for seven by nine pixel characters, for instance, the character code is accessed nine times to find the pixels needed for the nine consecutive scan lines that comprise the current line of characters. In a character oriented frame buffer it is generally permissible to rearrange or edit the display through firmware manipulation of the contents of the frame buffer. This is achieveable because the number of addresses in the frame buffer is small, and the whole frame buffer can, if necessary, be rewritten in a relatively short period of time. Thus, a scrolling operation in a character oriented frame buffer requires only firmware and no extra hardware to achieve acceptable performance.

No such simplicity attaches to bit-mapped displays, unfortunately. Therein is simply too much memory for the firmware to manage by rewriting the frame buffer as a whole. To move segments or parts of the displayed information from one location of the display to another, or to perform some uniform operation upon all the pixels within a bounded area of the display, requires some hardware assistance if it is to occur at acceptable speeds. As an added consideration, some systems where a graphics capability is standard dispense altogether with a character oriented frame buffer in favor of simply putting the character pixels for an alpha type display into the bit-mapped frame buffer, as if they were just so much graphics information, anyway. This saves memory, but it makes it absolutely necessary to have some sort of hardware bit-mover available if one is to be able to scroll through a displayed program listing with the same speed as possible with the older alpha-only type displays.

It is common for a bit-mapped display to have a hardware assistance circuit to increase performance relating to editing or manipulating the information presented in the display. That is, for assistance in rearranging the bits in the frame buffer. One common such circuit is the so-called "barrel mover." These are switching circuits that allow a parallel presentation of bits representing adjacent pixels on a scan line to be shifted with respect to the boundaries of the parallel representation and then stored into a different location in the frame buffer. The "parallel presentation" is usually something like sixteen, thirty-two or perhaps sixty-four bits, and represents a data path to and from the frame buffer. In operation a barrel shifter reads, say, a sixteen bit segment of a scan line and shifts it some specified amount before writing it back into a different segment of a different scan line. The shifting misaligns the ends of the shifted segment with respect to the fixed boundaries of the data path; bits shifted "past the end" of the fixed segment boundaries are saved for use in the next read-shift-write operation. Such saved bits from the previous read-shift-save operation are combined with the "hole" created by the shifting of the newly read and shifted bits for the next operation.

A barrel mover is fast and requires only a minimum of supervisory attention from the firmware. But it is a complicated circuit and is expensive. In a color graphics application one barrel mover is needed for each plane in the frame buffer. This means that a high performance color graphics display can be very complicated and expensive.

Thus, at one extreme there is the low cost possibility of using only firmware to manipulate the display, and at another extreme is an expensive and complicated barrel mover. It would be desirable if there were a way to approach the performance of a barrel mover without incurring the cost of one.

Such an advantageous combination is achieved by the present invention where two shift registers, a simple single bit ALU and a control circuit are combined to automatically move an arbitrary segment of a scan line to an arbitrary location in another scan line. A segment or a portion thereof of consecutive pixels from the source location are read in parallel into a source data shift register. A corresponding segment or portion thereof of consecutive pixels from the destination may be parallel loaded into a destination data shift register if a replacement rule operation is to be performed. (That is, if the source data is to be somehow combined with the destination data, rather than simply replacing it.) The pixels are simultaneously and synchronously shifted out of each shift register and presented to the ALU, where they are combined and the result shifted back into the destination data shift register. As far as the destination data shift register is concerned, the modified collection of pixels from the ALU is shifted "in the front," so to speak, as the unmodified pixels are shifted "out the back." Once the destination data shift register contains the complete new or modified segment or portion thereof, those pixels are written to the destination address in the frame buffer, and the process continues, if necessary.

In the present embodiment a field of sixty-four pixels can be read, shifted and combined and then written as a "unit operation." The width of the segment to be moved can be larger, and its width is specified (in pixels) by the window width portion of the "window width/# of lines" register. If the segment to be moved is wider than sixty-four pixels the control circuit will automatically continue the unit operation of reading, shifting and writing until the entire segment has been moved. A "number of lines" portion of that same register will cause an automatic repetition of the same sequence of unit operations, save that they are done with source and destination scan lines that are each adjacent the scan lines previously operated upon.

Moves can start at any pixel on a source scan line and can be to any pixel in the destination scan line. Corresponding source and destination pixels that have differing locations within their respective sixty-four pixel fields are accommodated by a preliminary "closed loop" shifting of the destination shift register. This undoes the offset between the source and destination segments insofar as they appear in the shift registers. If several fields are processed to handle a large segment of a scan line the reads into the source data shift register and writes from the destination data shift register will be staggered in time.

DESCRIPTION OF THE PREFERRED EMBODIMENT

Figure 1:
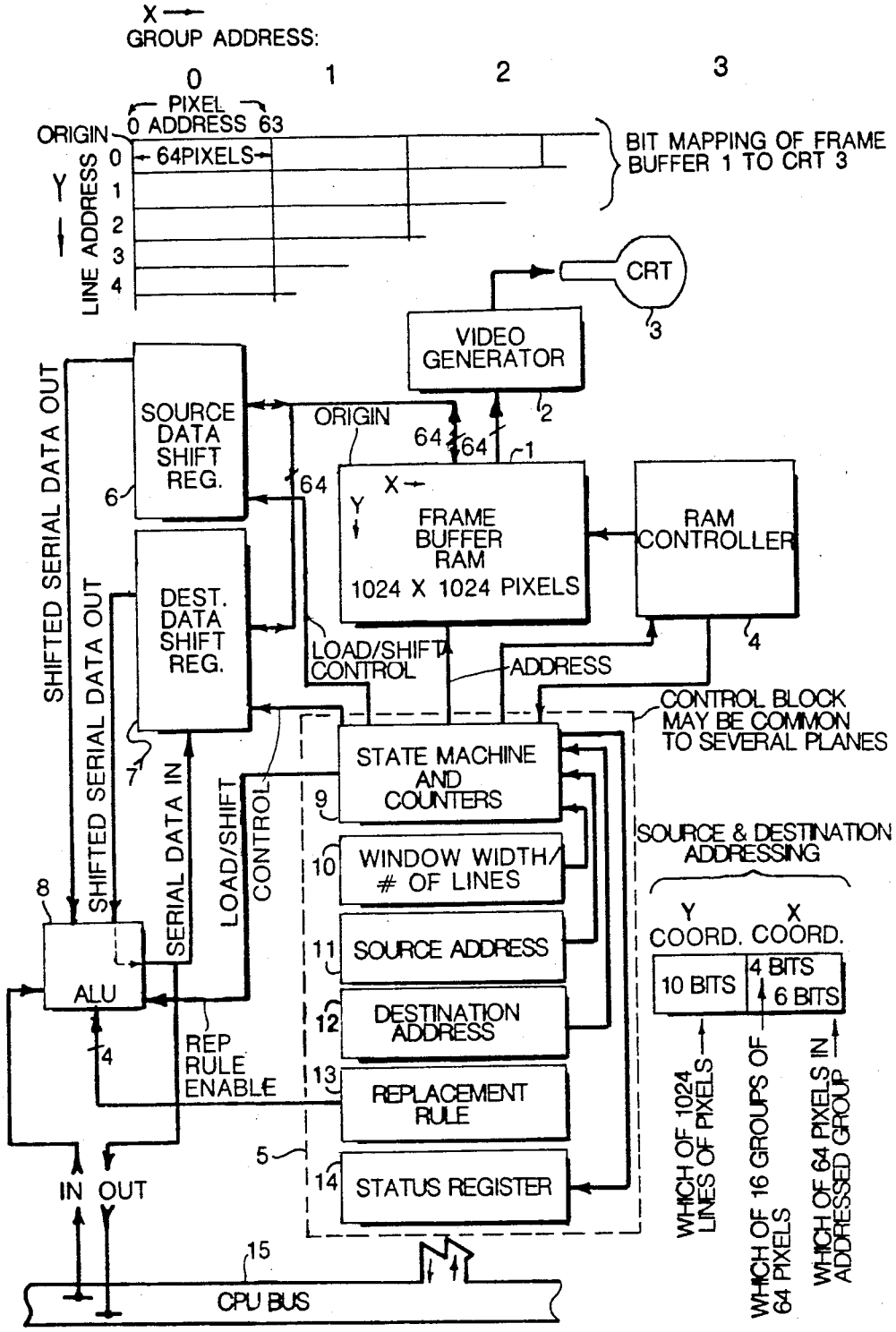
FIG. 1 is a simplified block diagram of a line mover circuit for reading source pixels from a frame buffer for a bit-mapped display, shifting and combining them with destination pixels, and then writing the result into a destination location in the frame buffer.

Referring now to the simplified block diagram of the invention shown in FIG. 1, a frame buffer RAM 1 is coupled to a video generator 2 which in turn drives a CRT 3. For the sake of simplicity, assume that the frame buffer 1 contains a single plane, and that the display generated on the CRT 3 is a monochrome presentation. A RAM controller 4 addresses the frame buffer 1 according to addresses generated by a control block 5. Within the control block 5 are several control registers, among which are: a window width/# of lines register 10; a source address register 11; a destination address register 12; a replacement rule register 13; and, a status register 14. These registers are coupled to a CPU bus 15 by means of which the controlling firmware of the host system controls and monitors the activity of the line mover. That is, data to be displayed and instructions and further data pertaining to editing and manipulating the contents of the frame buffer 1 are all sent to the system under consideration by means of the CPU bus 15.

Control block 5 also contains various state machines and counters (collectively denoted by reference numeral 9) which will assist in implementing the operational properties of the line mover. We shall turn our attention to those properties as soon as the remaining elements of the block diagram of FIG. 1 have been introduced.

A source data shift register 6 is coupled to receive in parallel sixty-four bit fields of consecutive pixels read from the frame buffer 1. In like fashion, a destination data shift register 7 is also coupled to the frame buffer 1 for both reading and writing sixty-four bits in parallel. The shifted serial data output from source data shift register 6 is coupled to one input of an ALU 8. Likewise, the shifted serial data output from destination data shift register 7 is coupled to a second input of the ALU 8. The output of the ALU 8 is coupled to two places: the serial data input of the destination data shift 7 register and the CPU bus 15. A set of four control lines from the replacement rule register 13 determines how the ALU 8 will produce an output in response to the various inputs presented to it. The ALU 8 can generate as its output either an input from the CPU bus 15, an individual one of the two shifted serial data outputs from shift registers 6 and 7, or a logical combination (AND, OR, NOR, XOR) of those two shifted serial data outputs or of one of those two inputs and the input from the CPU bus 15.

The ALU used in the present embodiment was simply an eight-line multiplexer configured to perform the functions set out above, as well as an additional function of ignoring the replacement rule and generating as the output the input received from the destination data shift register 7. This latter aspect of ALU operation is discussed later, and is under the control of the signal REP RULE ENABLE. If that signal is true the replacement rule specified by replacement rule register 13 is followed, using various ones of the three data inputs to the ALU 8. If REP RULE ENABLE is false the dotted line relationship shown in the ALU 8 of FIG. 1 obtains. The eight line multiplexer may be an SN 74S251 from the Texas Instruments Corp.

Following these additional preliminaries we shall be ready to undertake an examination of the operation of the shift registers 6 and 7 in conjunction with ALU 8 and the control block 5. First, it may be useful to point out how pixel data to be displayed is initially loaded into the frame buffer 1. Although some considerable control is involved, a simplified description is that the data is made to serially appear on the input line from the CPU bus 15 to the ALU 8. The ALU 8 simply passes the data through to the destination data shift register 7. As the incoming pixel data accumulates into sixty-four bit fields it is written to the appropriate location in the frame buffer 1. Next, observe how the addresses are encoded within the source address and destination address registers 11 and 12. These are each twenty-bit registers whose ten most significant bits define which of the 1024 scan lines is selected, and whose ten least significant bits address a pixel within the addressed scan line. To this end the ten least significant bits are further divided into an upper four bits and a lower six bits. The upper four bits are a group address that is used in forming an addresses for a memory cycle to the frame buffer 1. Such a memory cycle involves a sixty-four bit field of data. The lower six bits of the address registers 11 and 12 identify pixels within such a field, and are used in determining certain types of offsets that occur in the operation of the source data and destination data shift registers 6 and 7. Those lower six bits do not address the frame buffer directly.

The result of this addressing scheme is depicted in the map at the top of FIG. 1. The map applies both to the image appearing on the face of the CRT 3 as well as to the manner in which data is stored in the frame buffer 1. The point identified as "origin" corresponds to the upper left-hand corner of the raster. Scan lines are generated from left-to-right (as viewed from the front of the CRT) and in the order of the top-most scan line first, bottom-most last. The left-to-right direction along a scan line is the X axis, along which there are x coordinates. Similarly, the direction of the successive scan lines is the Y axis, along which each scan line occupies a y coordinate.

And finally, we may note the following general aspect of memory control for the frame buffer 1. It amounts to a non-contentious dual-port memory. Every other microsecond is allocated by the RAM controller 4 for memory cycles on behalf of the video generator 2.

The video generator 2 reads sixty-four bits at a time and uses an internal shift register (not shown) to generate the display during the remainder of that microsecond as well as during the intervening microsecond when it does not have access to the frame buffer 1. During the every other intervening microsecond data may be transferred between the frame buffer 1 and the source data and destination data shift registers 6 and 7.

The line mover is used by first writing the replacement rule and the various other control parameters and addresses to their respective registers. A write operation to the destination address register 12 causes the line mover to begin operation.

To begin an explanation of the use and operation of the invention, let us first consider a fairly simple case. Suppose that it were desired to move groups one, two and three of line one to the location of groups five, six and seven of line nine. The move operation may be one of direct replacement of the destination pixels by the source pixels, or it may involve combining the source pixels with the old destination pixels to produce the new destination pixels. For example, it may be desired to OR the two together, pixel by pixel. Whichever is the case, the host CPU (not shown) sets the appropriate replacement rule code into the replacement rule register 13. For this example the window width/# of lines register 10 would be set to indicate a width of one hundred and ninety-two pixels and one scan line.

Suppose that what is required is direct replacement, with no attention paid to the original values of the pixels at the destination location. Suppose further, as in the example here under consideration, that both the source and destination addresses begin on a group boundary. In such a special circumstance no shifting is required. All that is required is for the first source group (group one of line one) to be read directly into the destination data shift register 7 and then written directly into the first destination group (group five of line nine). Then the process can be repeated with the next source and destination groups, and so on. Groups that match up, pixel zero to pixel zero, and pixel sixty-three to pixel sixty-three, are said to be aligned, regardless of whether they have the same group number as an address. What can be seen here is a special case that requires no shifting for the left-most group (because the entire group is used without misalignment between the source and destination groups), no shifting for any inner-most groups (for the same reasons), and no shifting for the last group (again for the same reasons). The state machines in the state machine and counter circuitry 9 recognize these special circumstances (i.e., any aligned move of a complete group), and automatically perform that move in the manner described. That is, by direct read from the source group into the destination data shift register 7 followed by an immediate write therefrom to the destination group. This is achieved by detection in the state machines: that the replacement rule is one that does not depend upon the existing contents of the destination; that a left-most group starts with pixel address zero, and that the window width is at least sixty-four pixels; that a group is wholly an interior group of a segment whose left-most group meets the previous conditions; and that a right-most group is being transferred in its entirety while the left-most group meets the previously stated conditions.

The above described special case has particular utility when the frame buffer contains pixels representing characters. Say, for example, the display were divided into two or more regions, at least one of which was a vertical column or band of character information. Then the software could cause fairly rapid scrolling of that column by means of the special case described.

Now consider a more general case. Let the replacement rule be one performing genuine modification rather than direct replacement and assume that an entire source group is to be moved that is an interior group (i.e., it isn't at either end) in a segment that is not aligned. That is, the source group is neither the left-most nor right-most group, the left-most pixel of the segment is not pixel zero of the left-most group but some other pixel in that group, and that the window width is totally arbitrary (although long enough to be consistent with the foregoing assumptions). Temporarily ignoring the end groups, how is such an interior nonaligned source group moved?

Suppose the contents of the destination data shift register 7 have just been written to the previous destination location group. The next thing that would happen is that the next destination group is read into the destination data shift register 7. At this time the state machine and counter circuitry 9 causes both the source data shift register 6 and the destination data shift register 7 to begin synchronous and simultaneous shifting. What is shifted out of the source data shift register 6 is applied to the ALU 8, as is the shifted serial data output from the destination data shift register 7. The output of the ALU is serial data modified according to the replacement rule in use, and is shifted back into the destination data shift register 7. After sixty-four shifts the new or modified destination data is complete and present in the destination data shift register 7. All that remains is for that data to be written back to the destination group during the next available memory cycle. Now it is likely that sometime during the middle of those sixty-four shifts the last "unused" bit from the source data shift register 6 would have been shifted out. Before further shifting can proceed the next source group needs to be read into the source data shift register 6. Once that is done shifting can be resumed. How many shifts separate the destination data shift register's write (of modified data) and immediate read of the next (unmodified) destination group from the source data shift registers's read of the next source group depends upon the relative offset between the source and destination pixel addresses (within their respective groups). For example, to start from pixel ten of group two of line three and move a multi-group segment to start at pixel twenty-five of group eight of line ninety involves a six-group plus fifteen-pixel offset. Group offsets are easily handled, since they are directly addressable as data fields, but pixel offsets are of special concern to the left-most and (possibly also to the) right-most groups of a segment being moved.

Suppose that there is a fifteen-pixel offset for the reason that the source and destination addresses are as set out in the previous paragraph. Consider what must be done to move the left-most group. First, the left-most source group is read into source data shift register 6. Then the left-most destination group is read into the destination data shift register 7. By our premise, if pixel ten were about to be shifted out of the source data shift register 6 it would then be necessary for pixel twenty-five to be the next pixel shifted out of the destination data shift register. The first nine pixels in the source data shift register 6 that are ahead of that tenth pixel are of no concern; they are not needed. Accordingly, the source data shift register can be given nine preliminary shifts with no corresponding shifts issued to the destination data shift register 7. Those nine bits are simply lost. However, the twenty-four bits ahead of the twenty-fifth bit in the destination data shift register 7 must be saved, as they will need to be unchanged when written back to the left-most destination group. The line marked REP RULE ENABLE can be set to a value that allows the shifted serial data output from the destination data shift register 7 to pass unmodified through the ALU 8 and back into the destination data shift register 7 as the serial data input. Accordingly, the line REP RULE ENABLE is set by state machine and counter circuitry 9 to allow such unmodified passage and twenty-four shifts are issued to the destination data shift register 7. After the fashion of CPU instruction sets, we may say that the contents of the destination shift register 7 have been rotated by twenty-four bits. Following these preliminaries synchronous and simultaneous shifting with an enabled replacement rule can begin. Such shifting will continue until one of the shift registers has shifted its sixty-fourth pixel (relative to when it was last loaded which would be the pixel whose pixel address was originally sixty-three). At that time it is necessary to read from the frame buffer 1 (in the case it is the source data shift register 6 that ran out of pixels) or to write and then read (if the destination data shift register 7 ran out of pixels). Note that either shift register could run out of pixels first, depending upon which has the greater offset from the start of the group (i.e., the greater starting pixel address in the left-most group).

A similar sort of partial shift-register-shifting and replacement-rule-disabling occurs in the right-most destination group. This is determined by the width of the window taken in conjunction with where the move started. If the last pixel shifted for the benefit of applying the replacement rule is not the sixty-fourth pixel in that group then the replacement rule is disabled as before and the destination data shift register 7 shifted around into itself (rotating its contents) until its contents are normally aligned with actual destination group in the frame buffer 1. At that time the contents of the destination data shift register are written to the frame buffer and the move of that scan line is complete.

At this point the state machine and counter circuitry 9 decrements the value in the "# of lines" portion of register 10, and if a nonzero value remains begins the entire move process over again with incremented values for the Y coordinates of the source and destination addresses. Otherwise the move is complete.

Another mode of operation is possible. A particular replacement rule may be specified that causes the output of the ALU 8 to be the input supplied from the CPU bus 15. This has two uses. First, it provides a way for the CPU to address and then read or write individual pixels to the frame buffer 1. This can be done for any individual pixel without disturbing the others. The second use follows from the first. It provides a way for the CPU to supply the frame buffer 1 with the pixels to be displayed in the first place.

The source and destination addresses can be in the same scan line, if that is desired, although it may cause a problem if the segment to be moved overlaps the final segment to be produced. In this case the order in which the fields are operated upon is very important, as it is possible to write new pixels into a destination field that is also part of the source segment and that was supposed to provide its own source pixels for its own destination. One solution to this problem is to process the fields of the segment in reverse order. Unfortunately, this can add considerable complexity to the controlling circuitry. Another solution is preferred, and it is quite a bit simpler. It is to simply arrange that the frame buffer contain an addressable location for a scan line of pixels that are never displayed. Then if a scan line is to experience a move with overlapping segments, that entire scan line is first written to the non-displayed line in the frame buffer. Next, the desired segment is moved from there back into the desired location in the original scan line. A similar difficulty arises and similar solutions obtain when considering moves in the vertical direction where the source and destination segments overlap.

I claim:

1. Apparatus for moving to a different location in a frame buffer a collection of bits corresponding to a plurality of adjacent pixels in a bit-mapped display, the apparatus comprising:

memory means, coupled to the source and destination address means' recited below, for storing and retrieving groups of bits respectively corresponding to pluralities of adjacent pixels that are to be displayed, all bits in a group being stored and retrieved in unison in accordance with which group among a plurality of groups is selected by the group address portions recited below;

display means, coupled to the memory means, for generating a display of pixels corresponding to the groups of bits stored in the memory means;

source address means, coupled to the memory means, for specifying a source address that comprises a group address portion and a pixel-within-group address portion and that identifies a location in the memory means beginning at which a source collection of bits corresponding to a plurality of adjacent pixels is to be moved from;

destination address means, coupled to the memory means, for specifying a destination address that comprises a group address portion and a pixel-within-group address portion and that identifies a location in the memory means beginning at which the source collection of bits will be moved to;

source shift register means, coupled to the memory means, for loading in parallel a group of bits read from the memory means according to the group address portion of the source address, and having a serial data output for serially shifting those bits out;

destination shift register means, coupled to the memory means, for reading and writing in parallel a group of bits to and from the memory means according to the group address portion of the destination address, and having a serial data input and a serial data output for serially shifting groups of bits in and out, respectively;

shift control means, coupled to both the source and destination address means and to both the source and destination shift register means, for initially shifting the source shift register means by an amount equal to the offset in pixels between the start of the collection to be moved and an end-most pixel of the group read into the source shift register means, for initially rotating the contents of the destination shift register means by an amount equal to the difference between the pixel address portions of the source and destination addresses, and for subsequently rotating the contents of the destination shift register means by an amount that returns the contents of the destination shift register means to the positions occupied prior to the initial rotation; and ALU means, having a data output coupled to the serial data input of the destination shift register means, data inputs respectively coupled to the serial data outputs of the source and destination shift register means, and having a plurality of control inputs determining a replacement function of the data inputs according to which the value of the data output from the ALU means is produced, for combining according to the replacement function serial data simultaneously shifted out of the source and destination shift register means into serial data shifted into the destination shift register means.

2. A method of moving to a different location in a frame buffer a collection of bits corresponding to a collection of adjacent pixels in a bit-mapped display, the method comprising the steps of:

a. reading in unison from a frame buffer a group of bits addressed by a source address including source group and pixel-within-group address portions;

b. storing in unison into a source shift register the group of pixels read in step a;

c. reading in unison from the frame buffer a group of bits addressed by a destination address including destination group and pixel-within-group address portions;

d. storing in unison into a destination shift register the group of pixels read in step c;

g. in synchronism with steps h and i, simultaneously shifting the source and destination shift registers;

h. in synchronism with steps g and i, combining serial data streams shifted out of the source and destination shift registers into a single data stream;

i. in synchronism with steps g and h, shifting the combined serial data stream of step g into the destination shift register; and then k. writing the contents of the destination shift register into the frame buffer at the destination group address.

3. A method as in claim 2 further comprising, subsequent to the first application of steps (a) and (b) prior to the first application of steps (g), (h) and (i), the additional steps of:

e. shifting the source shift register by a number of bits corresponding to the pixel-within-group address portion of the source group address; and f. rotating the contents of the destination shift register by a number of bits equal to the difference between the pixel-within-group address portions of the source and destination addresses.

4. A method as in claim 3 wherein steps (a) through (d) and (g) through (i) are repeated with consecutive group address portions until the entire collection of adjacent pixels to be moved has reached the destination shift register.

5. A method as in claim 4 further comprising, prior to the final application of step (k), the step of:

j. rotating the destination shift register by a number of bits corresponding to the difference between the number of bits in the destination shift register and the pixel-within-group portion of the destination group address.

* * * * *